US008881539B1

(12) United States Patent
El-Shaarawi et al.

(10) Patent No.: US 8,881,539 B1
(45) Date of Patent: Nov. 11, 2014

(54) HYBRID STORAGE ABSORPTION REFRIGERATION SYSTEM

(71) Applicant: King Fahd University of Petroleum and Minerals, Dhahran (SA)

(72) Inventors: Maged Ahmed El-Shaarawi, Dhahran (SA); Syed Ahmed Said, Dhahran (SA); Farooq Riaz Siddiqui, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 14/137,163

(22) Filed: Dec. 20, 2013

(51) Int. Cl.
*F25B 15/00* (2006.01)
*F25D 17/02* (2006.01)
*F25C 1/04* (2006.01)

(52) U.S. Cl.
CPC ..... *F25B 15/00* (2013.01)
USPC ..... 62/101; 62/185; 62/356; 62/486

(58) Field of Classification Search
USPC ..... 62/101, 476–497, 356, 185
See application file for complete search history.

(56) References Cited

U.S. PATENT DOCUMENTS

| | | | | |
|---|---|---|---|---|
| 2,088,277 | A * | 7/1937 | Normelli | 62/480 |
| 2002/0108390 | A1* | 8/2002 | Ichikawa et al. | 62/324.2 |
| 2003/0221438 | A1* | 12/2003 | Rane et al. | 62/271 |
| 2004/0261446 | A1* | 12/2004 | Gupte | 62/497 |
| 2005/0126211 | A1* | 6/2005 | Drost et al. | 62/476 |
| 2007/0089449 | A1* | 4/2007 | Gurin | 62/324.2 |
| 2010/0281899 | A1* | 11/2010 | Garrabrant | 62/238.1 |
| 2011/0167854 | A1* | 7/2011 | Edwards et al. | 62/235.1 |

FOREIGN PATENT DOCUMENTS

| | | | |
|---|---|---|---|
| CN | 1945166 | A | 4/2007 |
| CN | 101196351 | A | 6/2007 |
| CN | 101178230 | A | 5/2008 |
| CN | 101231044 | A | 7/2008 |
| WO | WO 2010/063840 | A2 | 6/2010 |
| WO | WO 2012/041304 | A2 | 4/2012 |

OTHER PUBLICATIONS

Wang et al., "Low-temperature absorption refrigerator for storing food, having ammonia-water recycle system having high-temperature generator, heat exchangers, valve, low-temperature absorber and storage tank, and ammonia steam recycle loop", Dec. 21, 2007, eSpace, CN101196351, all.*

(Continued)

*Primary Examiner* — Marc Norman
*Assistant Examiner* — Filip Zec
(74) *Attorney, Agent, or Firm* — Oblon, Spivak, McClelland, Maier & Neustadt, L.L.P.

(57) ABSTRACT

A hybrid storage absorption refrigeration system and method. The system includes a thermal collector, a condenser, an evaporator, a cold storage tank, an absorber, a weak solution tank, a strong solution tank, a refrigerant storage tank, a refrigerant heat exchanger, and a solution heat exchanger. The method includes providing heat from a thermal collector to produce a refrigerant vapor from strong solution, condensing the refrigerant vapor, producing a refrigeration effect in an evaporator, chilling a cold storage medium in a cold storage tank, combining refrigerant vapor with weak solution in an absorber to produce strong solution, storing weak solution, storing strong solution, storing refrigerant, exchanging heat between hot and cold refrigerants in a refrigerant heat exchanger, and exchanging heat between weak solution and strong solution in a solution heat exchanger.

20 Claims, 1 Drawing Sheet

(56) References Cited

OTHER PUBLICATIONS

J.M. Abdulateef, et al., "Optimum Design for Solar Absorption Refrigeration Systems and Comparison of the Performances Using Ammonia-Water, Ammonia-Lithium Nitrate and Ammonia-Sodium Thiocyanate Solutions", International Journal of Mechanical and Materials Engineering (IJMME), vol. 3, 2008, No. 1, pp. 17-24.

U. Jakob, et al., "Simulation and Performance of Diffusion Absorption Cooling Machines for Solar Cooling", Published in the Proceedings of the 9$^{th}$ World Renewable Energy Congress., Florence, Aug. 21-25, 2006.

* cited by examiner

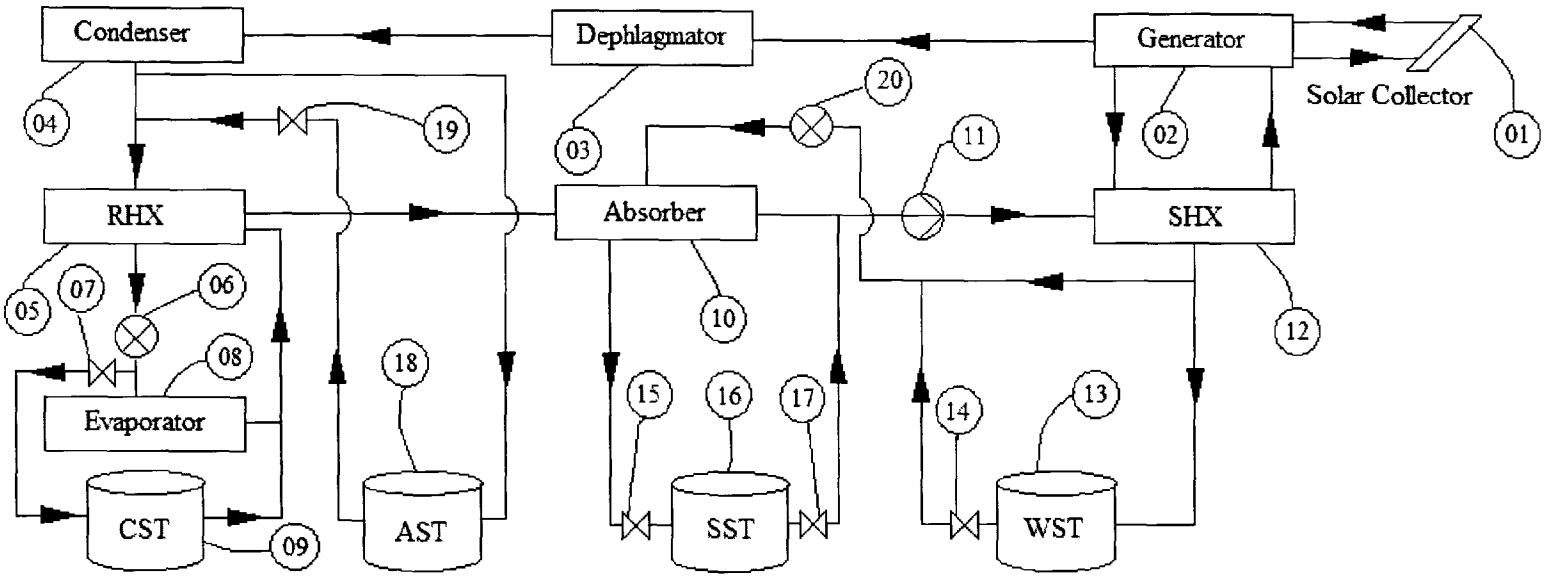
Solar Collector
01
Generator
02
SHX
12
WST
13
14
11
20
17
SST
16
15
Dephlagmator
03
Absorber
10
19
AST
18
Condenser
04
RHX
05
06
07
08
Evaporator
CST
09

HYBRID STORAGE ABSORPTION REFRIGERATION SYSTEM

BACKGROUND

1. Field of the Disclosure

The invention relates to a refrigerant storage system and apparatus, a cold storage system and apparatus, a hybrid refrigerant storage and cold storage system and apparatus, an absorption refrigeration system and apparatus, and a refrigeration method using the same.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Different refrigeration designs have been studied in the past to ensure continuous refrigeration for 24 hours a day. Storage designs include heat (sensible and latent) storage systems, cold (ice) storage systems, and refrigerant storage systems. Each storage system has its limitations, for example, heat storage systems require efficient solar collectors which make the systems expensive, cold storage systems have lower coefficients of performance, and refrigerant storage systems are both expensive and bulky, often requiring large, thick-walled high and low pressure vessels.

It is often more efficient to carry out refrigeration at night when ambient temperatures are lower and refrigeration systems are required to achieve a less demanding temperature change. However, when refrigeration is carried out using solar energy or similar techniques it may be difficult to achieve sufficient refrigeration during night time hours. Storing a substance that was previously refrigerated is one means by which cooling potential may be made available for 24 hour cooling even using solar energy.

SUMMARY

In an embodiment, a hybrid storage absorption refrigeration system includes a thermal collector, a generator, a condenser, an evaporator, a cold storage tank, an absorber, a weak solution tank, a strong solution tank, a refrigerant storage tank, a refrigerant heat exchanger, and a solution heat exchanger.

In another embodiment, the refrigerant is ammonia and the absorbent is water.

Another embodiment includes a dephlegmator.

In another embodiment, an evaporator operates at a temperature below −10° C.

In still another embodiment, a hybrid storage absorption refrigeration method includes chilling a cold storage medium in a cold storage tank, storing in a weak solution tank a portion of a weak solution, storing in a strong solution tank a portion of a strong solution, and storing in a refrigerant storage tank a portion of a liquid refrigerant.

Another embodiment includes permitting a strong solution stored in a strong solution tank to enter into a generator.

Yet another embodiment includes controlling a flow rate of a refrigerant to a cold storage tank such that an amount of chilled cold storage medium is produced to share a nighttime cooling load.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawing, wherein:

FIG. 1 is a schematic view of a hybrid storage absorption refrigeration system according to an embodiment.

DETAILED DESCRIPTION OF THE EMBODIMENTS

In an embodiment, as shown in FIG. 1, during the daytime, heat is provided by solar collector 01 to generator 02 to produce an aqua-ammonia vapor from an aqua-ammonia solution. In other embodiments, different absorbent-refrigerant combinations other than aqua-ammonia may be used, for example, lithium bromide-aqua, lithium nitrate-ammonia, or sodium thiocyanate-ammonia. As shown in FIG. 1, and in embodiments of the invention, the components of the system may be directly connected to one another, for example, by connecting pipes, without intervening components. Also, valves may be disposed in a variety of ways, for example, between portions of connecting pipes, or for example, integrally to other system components.

A solar collector according to an embodiment is a thermal collector, which comprises a heat exchanger, and may comprise any of various configurations of structures adapted for use with various heat sources, such as sunlight, exhaust gas, or geothermal heat, for example. A solar collector, according to an embodiment, converts energy from sunlight into thermal energy that can be used to perform mechanical work on a fluid. In various embodiments, a solar collector may have one or more of various geometries including a flat plate, arc, or compound parabolic curve, for example. In other embodiments, a solar collector may exploit optical or other properties of sunlight, including absorption, reflection, or refraction, for example, to harness useable energy from sunlight. Preferably the solar collector collects solar energy in the form of heat rather than in the form of electricity or electrical potential. For example, in an embodiment of the invention the solar collector is not a photovoltaic cell.

A solar collector according to an embodiment need not have a solar energy storage capacity for storing solar energy when sunlight is not available. In an embodiment, solar energy can be the only heat source and no auxiliary heat source is necessary. In another embodiment, no additional thermal store is used anywhere in a thermal circuit comprising one or more thermal collectors and a generator. A solar collector according to an embodiment may have a solar collector fluid, for example water or another fluid suitable for operation as a medium for heat exchange, such as saline, antifreeze, or oil. A solar collector according to an embodiment may likewise be used to heat a fluid circulating in and out of the solar collector, for example water, or another fluid suitable for operation as a medium for heat exchange, such as saline, antifreeze, or oil.

Generator 02 may be constructed of a material such as stainless steel that can withstand the temperatures and pressures associated with evaporating a refrigerant out of an absorbent-refrigerant solution and that is compatible with the particular absorbent-refrigerant combination used in the system. According to an embodiment, a single high temperature generator may be used, without need of a middle or low temperature generator.

The water vapor present in the aqua-ammonia vapor is condensed by rejecting some heat to the concentrated aqua-ammonia solution and some heat to the liquid water coming from dephlegmator 03. A dephlegmator according to an embodiment is a device arranged for the partial condensation of an absorbent-refrigerant vapor. When, according to an embodiment, an absorbent-refrigerant solution enters a dephlegmator, the absorbent condenses while the refrigerant remains as a vapor. A dephlegmator according to an embodiment may have the form of a pipe with a heat exchanger. According to another embodiment, a dephlegmator may reject heat by free convection to the ambient air. A dephlegmator according to an embodiment may be constructed of a material such as metal, plastic, or glass, for example, that can withstand the temperatures and pressures associated with partially condensing an absorbent-refrigerant vapor and that is compatible with the particular absorbent-refrigerant combination used in the system. In an embodiment, in order to ensure at least 99.6% pure ammonia is supplied into the condenser, heat is removed from the vapor in dephlegmator 03 and the resulting condensed water is sent back to generator 02.

In condenser 04, the ammonia vapor dissipates heat and is converted into a saturated liquid. Condenser 04 may be constructed of a material such as metal, plastic, or glass, for example, that can withstand the temperatures and pressures associated with condensing refrigerant vapor and that is compatible with the particular refrigerant used in the system. In an embodiment, cooling water is used to draw heat out of the condenser. In another embodiment, the temperature of the cooling water is at least 3-5° C. less than the condenser temperature. The liquid ammonia coming out of condenser 04 is continuously sent into ammonia storage tank (AST) 18 for nighttime operation while the rest of the ammonia is used in the cycle during daytime operation. Ammonia storage tank (AST) 18 is a refrigerant storage tank and may be constructed of a material such as metal, plastic, or glass, for example, that can withstand the temperatures and pressures associated with storing liquid refrigerant and that is compatible with the particular refrigerant used in the system. In an embodiment, a refrigerant storage tank may have a single outlet. In another embodiment, a refrigerant storage tank may have multiple outlets.

The ammonia rejects heat while it passes through refrigerant heat exchanger (RHX) 05 and the ammonia's temperature further drops when it passes through expansion valve 06. Refrigerant heat exchanger (RHX) 05 acts as a medium for heat transfer from the saturated liquid ammonia flowing out of condenser 04 and to the saturated ammonia vapor flowing out of evaporator 08. In another embodiment, a refrigerant heat exchanger is not a gas-gas heat exchanger. A system according to another embodiment does not need to use an auxiliary gas such as helium.

After expansion valve 06, the ammonia refrigerant flow in an embodiment splits between evaporator 08 and cold storage tank (CST) 09. Evaporator 08 may be constructed of a material such as metal, plastic, or glass, for example, that can withstand the temperatures and pressures associated with evaporating liquid refrigerant into refrigerant vapor and that is compatible with the particular refrigerant used in the system. According to an embodiment, evaporator 08 may operate at temperatures below −10° C.

Cold storage tank (CST) 09 may be constructed of a material such as metal, plastic, or glass, for example, that can withstand the temperatures and pressures associated with generating cold and storing ice, and that is compatible with the particular refrigerant used in the system. In an embodiment, a cold storage tank may have a single outlet. In another embodiment, a cold storage tank may have multiple outlets.

A chilling effect produced in a cold storage tank according to an embodiment may be used to chill one or more cold storage media, for example water or saline. It may be advantageous in an embodiment to use a cold storage medium in which a phase change is effectuated by removing the latent heat of fusion from a liquid cold storage medium, thereby forming a solid cold storage medium, the melting of which can be used for later refrigeration.

According to an embodiment, the ammonia flow rate to cold storage tank (CST) 09 is controlled such that the required amount of ice is produced to share the night cooling load. Such control may be accomplished, for example, using valve 07, or the like. Thus, by producing ice during the daytime, the amount of ammonia refrigerant and weak solution required for nighttime operation can be reduced.

Ammonia is converted into a saturated vapor by absorbing heat in evaporator 08. Evaporator 08 may be constructed of a material such as metal, plastic, or glass, for example, that can withstand the temperatures and pressures associated with generating cold, and that is compatible with the particular refrigerant used in the system.

The saturated vapor coming out of evaporator 08 absorbs further heat in refrigerant heat exchanger (RHX) 05, becoming a supersaturated vapor.

In absorber 10, the supersaturated ammonia vapor is absorbed by the weak solution and hence a strong aqua-ammonia solution is formed by an exothermic process. Absorber 10 may be constructed of a material such as metal, plastic, or glass, for example, that can withstand the temperatures and pressures associated with a particular refrigerant being absorbed by an absorbent, and that is compatible with the particular absorbent and refrigerant, and their solution. Notably, an embodiment can use a single absorber. In another embodiment, no heat exchanger is used inside the absorber unit. In yet another embodiment, the strong solution is not preheated in the absorber before it enters the generator. In still another embodiment, the condenser unit is separated from the absorber unit.

The strong solution is pumped by pump 11 into solution heat exchanger (SHX) 12 where it is preheated to a saturation liquid state. According to various embodiments, the pump may be a mechanical pump, such as an electric motor-driven pump or the pump may be, for example, a bubble pump, operating under a difference in densities between different fluid species.

The strong solution then enters into generator 02 where it is further preheated by the aqua ammonia vapor. The saturated weak solution from generator 02 enters into solution heat exchanger (SHX) 12 where it rejects heat to the strong solution. The weak solution is continuously entered into weak solution tank (WST) 13 throughout the day so that the weak solution can be used for nighttime operation. The rest of the weak solution is introduced into absorber 10 through expansion valve 20.

The cycle continues throughout the day as long as solar energy is available.

Weak solution tank (WST) 13 may be constructed of a material such as metal, plastic, or glass, for example, which can withstand the temperatures and pressures associated with storing weak solution. In an embodiment, a weak solution tank may have a single outlet. In another embodiment, a weak solution tank may have multiple outlets.

When night starts, ammonia storage tank (AST) 18, which is filled with ammonia refrigerant, is allowed to enter into the refrigeration cycle. In an embodiment, night may be defined in terms of the availability of sunlight, such that night refers to any time when sunlight is not available. Night may also be defined, for example, in terms of an amount of heat input available from a thermal collector. That is, in an embodiment, night may be deemed to start even while the sun remains above the horizon, if a thermal collector stops providing sufficient heat input to a generator to produce refrigerant vapor. In still another embodiment, night may be defined in terms of an ambient temperature, for example, where the opening or closing of one or more valves is governed by a thermostat.

The cooling load is distributed between cold storage tank 09 and the ammonia refrigerant coming from ammonia storage tank (AST) 18. In other words, both these storage tanks share the cooling load to achieve the required cooling capacity of the chiller. Ammonia refrigerant enters absorber 10 where it is absorbed by the weak solution coming from weak solution tank (WST) 13. An exothermic process in absorber 10 results in the formation of strong solution which enters into strong solution tank (SST) 16. Strong solution tank (SST) 16 may be constructed of a material such as metal, plastic, or glass, for example, that can withstand the temperatures and pressures associated with storing the strong solution, and that is compatible with it. In an embodiment, a strong solution tank may have a single outlet. In another embodiment, a strong solution tank may have multiple outlets.

In an embodiment, both ammonia storage tank (AST) 18 and weak solution tank (WST) 13 are emptied during the night and strong solution tank (SST) 16 is filled by the end of the night. In another embodiment, the concentration of the strong solution at night is greater than the concentration during the daytime because the ambient temperature is lower at night. In another embodiment, the strong solution from strong solution tank (SST) 16 is continuously mixed with strong solution produced in absorber 10 during the daytime within the cycle, until strong solution tank (SST) 16 is empty by the end of the day. In another embodiment, during the daytime, valve 19, valve 14, and valve 15 are closed while valve 17 and valve 07 are opened.

A hybrid storage design, according to an embodiment, combines a refrigerant storage system with a cold (ice) storage system. The cooling load at night is shared between these two storage systems. During the daytime the ammonia tank and the weak solution tank are filled and water in a cold storage tank is converted into ice to suffice the nighttime cooling load. The storage tanks can be downsized by more than 50% if more cooling load is shared by the refrigerant storage system than by the cold (ice) storage system. This hybrid storage design is less expensive, less bulky, continues refrigeration if any storage tank needs maintenance, and offers a better coefficient of performance.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

Accordingly, we claim:

1. A hybrid storage absorption refrigeration system comprising:

a thermal collector that provides heat to a strong absorbent-refrigerant solution in a generator, thereby producing a first refrigerant vapor and a weak solution;

a condenser that condenses the first refrigerant vapor into a liquid refrigerant;

an evaporator that receives a first portion of the liquid refrigerant from the condenser and produces a first refrigeration effect by absorbing heat into the first portion of the liquid refrigerant, thereby evaporating it, producing a second refrigerant vapor;

a cold storage tank that receives a second portion of the liquid refrigerant from the condenser and absorbs heat out of a cold storage medium, thereby chilling the cold storage medium and evaporating the second portion of the liquid refrigerant, producing a third refrigerant vapor, the cold storage tank producing a second refrigeration effect by absorbing heat into the cold storage medium, the cold storage tank being removably attached to the refrigeration system such that the evaporator continues to produce the first refrigeration effect when the cold storage tank is removed;

an absorber that combines one or more of the second and third refrigerant vapors with the weak solution, thereby producing the strong solution for the generator;

a weak solution tank that receives a first portion of the weak solution from the generator and stores the first portion of the weak solution, the weak solution tank being removably attached to the refrigeration system such that one or both of the evaporator and the cold storage tank continue to produce one or both of the first and second refrigeration effects when the weak solution tank is removed;

a strong solution tank that receives a first portion of the strong solution from the absorber and stores the first portion of the strong solution, the strong solution tank being removably attached to the refrigeration system such that one or both of the evaporator and the cold storage tank continue to produce one or both of the first and second refrigeration effects when the weak solution tank is removed; and a refrigerant storage tank that receives a third portion of the liquid refrigerant from the condenser and stores the third portion of the liquid refrigerant, the refrigerant storage tank being removably attached to the refrigeration system such that one or both of the evaporator and the cold storage tank continue to produce one or both of the first and second refrigeration effects when the weak solution tank is removed.

2. A hybrid storage absorption refrigeration system comprising:

a thermal collector that provides heat to a strong absorbent-refrigerant solution in a generator, thereby producing a first refrigerant vapor and a weak solution;

a condenser that condenses the first refrigerant vapor into a liquid refrigerant;

an evaporator that receives a first portion of the liquid refrigerant from the condenser and produces a first refrigeration effect by absorbing heat into the first portion of the liquid refrigerant, thereby evaporating it, producing a second refrigerant vapor;

a cold storage tank that receives a second portion of the liquid refrigerant from the condenser and absorbs heat out of a cold storage medium, thereby chilling the cold storage medium and evaporating the second portion of the liquid refrigerant, producing a third refrigerant vapor, the cold storage tank producing a second refrigeration effect by absorbing heat into the cold storage medium, the cold storage tank being removably attached to the refrigeration system such that the evaporator continues to produce the first refrigeration effect when the cold storage tank is removed;

an absorber that combines one or more of the second and third refrigerant vapors with the weak solution, thereby producing the strong solution for the generator;

a weak solution tank that receives a first portion of the weak solution from the generator and stores the first portion of the weak solution, the weak solution tank being removably attached to the refrigeration system such that one or both of the evaporator and the cold storage tank continue to produce one or both of the first and second refrigeration effects when the weak solution tank is removed;

a strong solution tank that receives a first portion of the strong solution from the absorber and stores the first portion of the strong solution, the strong solution tank being removably attached to the refrigeration system such that one or both of the evaporator and the cold storage tank continue to produce one or both of the first and second refrigeration effects when the weak solution tank is removed;

a refrigerant storage tank that receives a third portion of the liquid refrigerant from the condenser and stores the third portion of the liquid refrigerant, the refrigerant storage tank being removably attached to the refrigeration system such that one or both of the evaporator and the cold storage tank continue to produce one or both of the first and second refrigeration effects when the weak solution tank is removed;

a refrigerant heat exchanger that exchanges heat between a hot side and a cold side, the hot side including one or more of the second and third refrigerant vapors, and the cold side including the liquid refrigerant;

a solution heat exchanger that exchanges heat between the weak solution produced in the generator and the strong solution produced in the absorber.

3. The system of claim 2, wherein the refrigerant is ammonia and the absorbent is water.

4. The system of claim 2, further comprising:

a dephlegmator that rectifies the first refrigerant vapor produced in the generator and supplies the first refrigerant vapor, in a rectified form, to the condenser.

5. The system of claim 4, wherein the rectified form of the first refrigerant vapor is at least 99.6% pure refrigerant.

6. The system of claim 2, further comprising an expansion valve that expands the liquid refrigerant after it passes through the refrigerant heat exchanger, thereby cooling it before it enters one or more of the evaporator and the cold storage tank.

7. The system of claim 2, further comprising an expansion valve that expands the weak solution after it passes through the solution heat exchanger, before it enters the absorber.

8. The system of claim 2, further comprising a pump that pumps the strong solution out of the absorber and into the generator.

9. The system of claim 2, further comprising a cooling water that draws heat out of the condenser.

10. The system of claim 9, wherein the temperature of the cooling water is at least 3-5° C. lower than the temperature of the condenser.

11. The system of claim 2, wherein the evaporator operates at temperatures below −10° C.

12. The system of claim 2, further comprising an expansion valve that expands the liquid refrigerant after it passes through the refrigerant heat exchanger, thereby cooling the liquid refrigerant before it enters the evaporator and the cold storage tank.

13. A hybrid storage absorption refrigeration method comprising:

providing heat from a thermal collector to a strong absorbent-refrigerant solution in a generator, thereby producing a first refrigerant vapor and a weak solution;

condensing the first refrigerant vapor into a liquid refrigerant in a condenser;

producing a first refrigeration effect in an evaporator by absorbing heat into a first portion of the liquid refrigerant, thereby evaporating the first portion of the liquid refrigerant into a second refrigerant vapor;

chilling a cold storage medium in a cold storage tank by absorbing heat out of the cold storage medium into a second portion of the liquid refrigerant, thereby producing a third refrigerant vapor;

producing a second refrigeration effect in the cold storage tank by absorbing heat into the cold storage medium;

combining one or more of the second and third refrigerant vapors with the weak solution in an absorber, thereby producing the strong solution for the generator;

storing in a weak solution tank a first portion of the weak solution from the generator;

storing in a strong solution tank a first portion of the strong solution from the absorber;

storing in a refrigerant storage tank a third portion of the liquid refrigerant from the condenser;

exchanging heat between a hot side and a cold side of a refrigerant heat exchanger, the hot side including the liquid refrigerant and the cold side including one or more of the second and third refrigerant vapors;

exchanging heat in a solution heat exchanger between the weak solution produced in the generator and the strong solution produced in the absorber; and continuing to produce one or more of the first and second refrigeration effects when one or more of the cold storage tank, the weak solution tank, the strong solution tank, and the refrigerant storage tank is removed.

14. The method of claim 13, further comprising permitting the third portion of the liquid refrigerant stored in the refrigerant storage tank to enter into one or more of the evaporator and the cold storage tank.

15. The method of claim 14, wherein the permitting occurs at nighttime.

16. The method of claim 13, further comprising permitting the first portion of the weak solution stored in the weak solution tank to enter into the absorber.

17. The method of claim 16, wherein the permitting occurs at nighttime.

18. The method of claim 13, further comprising permitting the first portion of the strong solution stored in the strong solution tank to enter into the generator.

19. The method of claim 18, wherein the permitting occurs during daytime.

20. The method of claim 13, further comprising controlling a flow rate of the second portion of the liquid refrigerant to the cold storage tank such that an amount of chilled cold storage medium is produced to share a nighttime cooling load between the evaporator and the cold storage tank.

* * * * *